US005665035A

United States Patent [19]

Tumminia

[11] Patent Number: 5,665,035

[45] Date of Patent: Sep. 9, 1997

[54] MARTIAL ARTS TRAINING APPARATUS

[76] Inventor: Ronald A. Tumminia, P.O. Box 181414, Casselberry, Fla. 32718

[21] Appl. No.: 788,417

[22] Filed: Jan. 27, 1997

[51] Int. Cl.[6] ..... A63B 69/00

[52] U.S. Cl. ..... 482/83; 482/83

[58] Field of Search ..... 482/83–90, 148, 482/904, 93, 23, 33; 473/441–445

[56] References Cited

U.S. PATENT DOCUMENTS

| | | | |
|---|---|---|---|
| 944,648 | 12/1909 | Austin | 482/86 |
| 4,171,803 | 10/1979 | Smith . | |
| 4,173,336 | 11/1979 | Perry . | |
| 4,295,646 | 10/1981 | Squire . | |
| 4,635,929 | 1/1987 | Shustack | 482/83 |
| 4,749,184 | 6/1988 | Tobin | 482/86 |
| 4,757,989 | 7/1988 | Bauer, Jr. . | |
| 4,889,334 | 12/1989 | Partlo . | |
| 5,256,069 | 10/1993 | Snowden, Jr. et al. | 482/83 |
| 5,458,551 | 10/1995 | Shenton . | |
| 5,476,433 | 12/1995 | Bruner . | |

FOREIGN PATENT DOCUMENTS

| | | | |
|---|---|---|---|
| 1407496 | 7/1988 | U.S.S.R. | 482/83 |

*Primary Examiner*—Jerome Donnelly

*Attorney, Agent, or Firm*—William M. Hobby, III

[57] ABSTRACT

A martial arts training apparatus includes a base adapted to be placed in a corner formed by intersecting walls and supported to the floor. A bracing frame member is attached to the base adjacent the intersecting building walls and has a wall cushioning or bracing member attached thereto. A training attachment support is used to support training attachments thereto and is attached to the base and extends generally vertically therefrom and a connecting frame member connects the bracing frame member with the training attachment support. A plurality of martial arts training attachments are removably attachable to the training attachment support so that a martial arts training apparatus can be placed in the corner adjacent intersecting building walls for providing a wide variety of martial arts training. Training attachments include a universally positionable board breaking attachment, a makiwara and a kicking training attachment having an attached resilient cord extending from the training attachment support to an ankle and foot attachment. Other attachments include a double paddle attachment and a string bag attachment.

20 Claims, 6 Drawing Sheets

MARTIAL ARTS TRAINING APPARATUS

BACKGROUND OF THE INVENTION

The present invention relates to a martial arts training apparatus and especially to a compact training apparatus which is easily assembled and disassembled for placement adjacent building intersecting walls for providing a variety of martial arts training aids.

Participants of martial arts, as in Tae Kwon do, Kung Fu, karate, and kick boxing, require a means of maintaining, improving, and accurately evaluating kicking and punching skills. Instructors also require a means of demonstrating various blows without risking injury to themselves or others. To achieve the aforementioned, boards commonly held by onlookers are used as targets. However, manual board holders fearful of flying boards, broken fingers, or broken wrists resulting from the power delivered to break boards, may unconsciously pull away from the blow, thereby ultimately increasing the risk of injury to both the board holder and breaker from an off target blow. An accurate means of evaluating individual performance is also difficult because sparring participants typically reduce the force of their kicks and punches to avoid permanent damage to their opponent. In addition, many hours of individual training on speed, timing, accuracy and power are necessary for maintaining and improving individual proficiency on the various techniques employed in martial arts. However, the amount and quality of individual training time is often restricted for most participants due to the inability to secure the assistance of a skilled board holder.

Various patents have been granted on devices which address and eliminate the need for manual board holders. Representative of the prior art devices include the following. U.S. Pat. No. 4,889,334 to Partlo discloses a device which provides a martial arts board holding structure which substantially reduces the possibility of injury to the hand or foot of the user, while minimizing the possibility of damage to the device itself. Furthermore, this device is adjustable and can hold from one to a substantial number of boards to be broken. A pedestal stand is attached to the board securing the frame member for support at a desired position above the floor surface.

U.S. Pat. No. 4,757,989 to Bauer, Jr. is a martial arts board holding device which is portable and rigidly holds one or more boards to receive a karate blow or the like. U.S. Pat. No. 5,458,551 to Shento is a reusable break-away board assembly which includes a base in a vertically extending support and a board latching member for holding a board for use in martial arts training. U.S. Pat. No. 4,171,803 is a karate practice breaking board while U.S. Pat. No. 4,173,336 to Perry is striking equipment for developing martial arts skills which is attached to a wall. U.S. Pat. No. 4,295,646 to Squire is a karate board holding and storage device. U.S. Pat. No. 5,476,433 to Bruner is a universal martial arts training apparatus which has a support module with a plurality of upstanding support members equidistantly spaced in parallel relation to each other. The support module presents independent training stations at a single location but spaced from each other on different sides of the support module and includes a speed break, power break, heavy weight bag, and a board holder.

In contrast to the prior art martial arts training devices, the present invention relates to a universal martial arts training system which is both compact and can be easily assembled and disassembled for placement adjacent building intersecting walls such that a very small space, such as a 10×10 foot corner area, can provide participants of martial arts with training in variety of skills. The training system provides for the rapid attachment and use any number of martial arts training attachments for improving kicking, punching, and boxing skills.

SUMMARY OF THE INVENTION

A martial arts training apparatus includes a base adapted to be placed in a corner formed by intersecting walls and supported to the floor. A bracing frame member is attached to the base adjacent the intersecting building walls and has a wall cushioning or bracing member attached thereto. A training attachment support is used to support training attachments thereto and is attached to the base and extends generally vertically therefrom and a connecting frame member connects the bracing frame member with the training attachment support. A plurality of martial arts training attachments are removably attachable to the training attachment support so that a martial arts training apparatus can be placed in the corner adjacent intersecting building walls for providing a wide variety of martial arts training. Training attachments include a universally positionable board breaking attachment, a makiwara and a kicking training attachment having an attached resilient cord extending from the training attachment support to an ankle and foot attachment. Other attachments include a double paddle attachment and a string bag attachment.

BRIEF DESCRIPTION OF THE DRAWINGS

Other objects, features, and advantages of the present invention will be apparent from the written description and the drawings in which.

DESCRIPTION OF THE PREFERRED EMBODIMENTS

Figure 1:
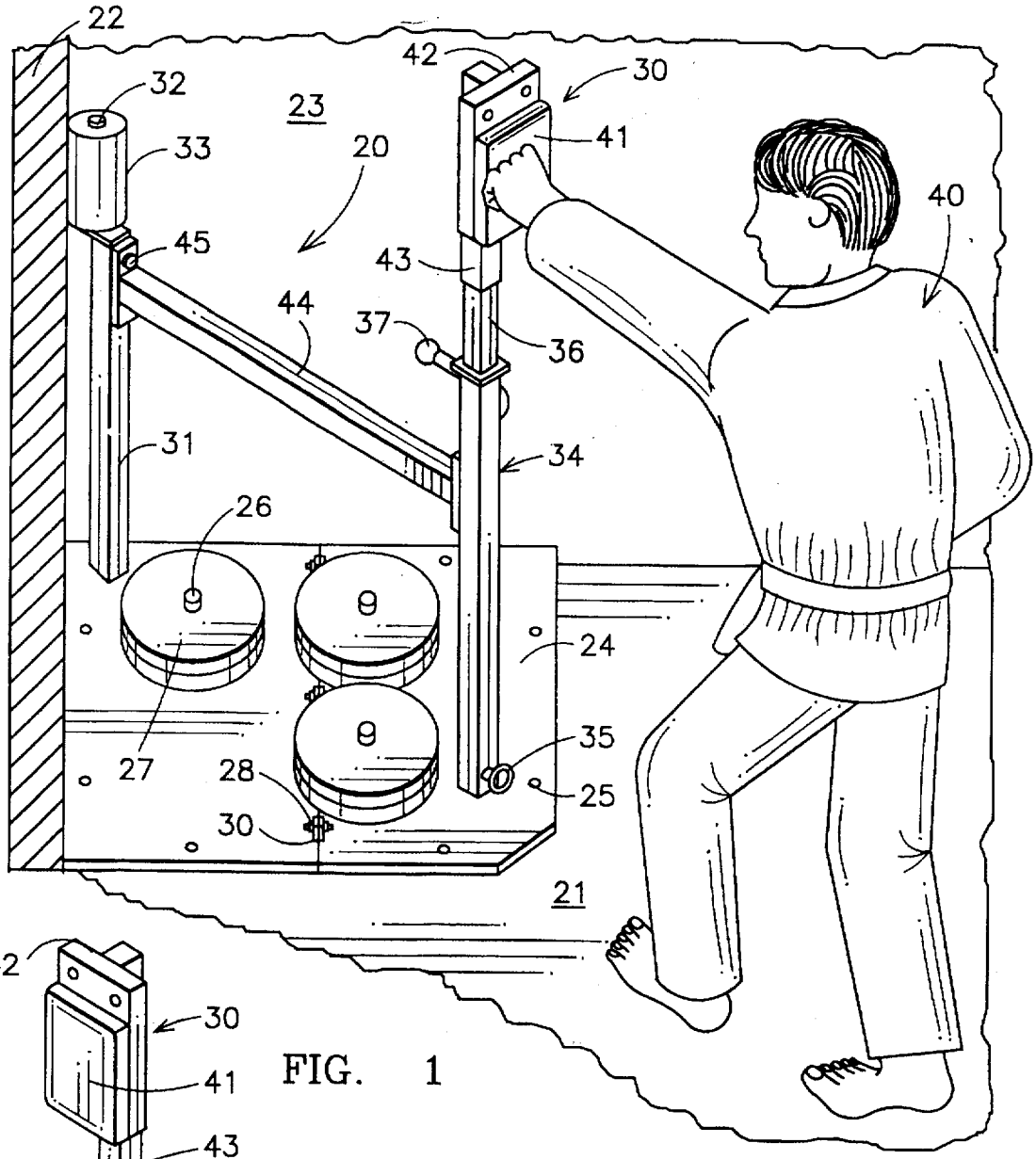
FIG. 1 is a perspective view of a martial arts training apparatus in accordance with the present invention having a martial arts trainee using the apparatus.

Referring to the drawings and especially to FIG. 1, the martial arts training apparatus 20 has been set up on the floor 21 of a building at the intersecting corners of walls 22 and 23. The apparatus 20 has a base 24 shaped to fit in the corner formed by the walls 22 and 23 and having a plurality of apertures 25 therein to allow the base to be bolted to the floor if desired. The base also has a plurality of outwardly extending rods or pegs 26 which support a plurality of weights 27 for holding the base 24 in place. Base 24 may be made in two pieces bolted together with a plurality of bolts 28 through a plurality of upwardly extending flange members 30. A wall bracing frame member 31 is attached to the base 24 and extends vertically therefrom. The frame member 31 can be removably attached to the base 24 with a pull pin and has a wall cushioning support bracket 32 attached to the top thereof supporting a wall bracing or cushioning member 33 which can be a cylindrically shaped resilient energy absorbing member slipped over the upwardly extending post 32 and positioned when the base 24 is in the corner. The bracing member 33 abuts both walls 22 and 23. A training attachment support member 34 is also removably attached to the base 24 and has a telescoping member 36 telescoping from the member 34 which can be locked at different positions with the locking pin 37. This allows for the member 36 to adjust the height of a martial arts training attachment, such as the makiwara or punching pad attachment 38 attached to the member 36. Adjustment is made final for the height of a trainee 40. The trainee 40 is illustrated standing on the floor 21 and punching the padded striking member. The makiwara is generally wrapped straw and is used for punching and, in this case, has the padded portion 41 attached to a rigid base 42. The attachment portion 43 is slipped over the post member 36 and positioned at a desired height for the trainee 40. A connecting frame member 44 is bolted with a bolt 45 to the bracing frame member 31 and is bolted to the training attachment support member 34 so that the force applied against the training attachment support 34 can be absorbed by the attachment to the base 24 and through the connection member 44 and against the bracing frame 31 to the rear portion of the base 24 which is cushioned against the wall with a wall cushioning member 33.

Figure 2:
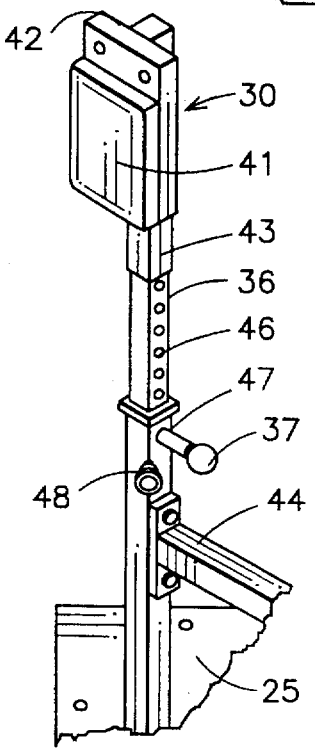
FIG. 2 is a perspective view of a striking pad training attachment.
Figure 3:
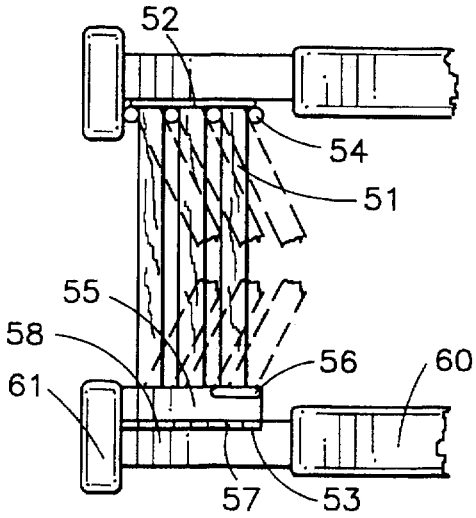
FIG. 3 is a partial elevation of a board breaking attachment having a plurality of boards being broken simultaneously.

As seen in FIG. 2, the telescoping training attachment support member 36 has a plurality of openings 46 in one side thereof which allows the locking pin 37 to slide through an opening 47 in the training attachment support member 34 and through an opening 46 to adjust the height of the telescoping member 36. A safety locking member 48 can also be threadedly bolted onto the telescoping member 36.

Figure 4:
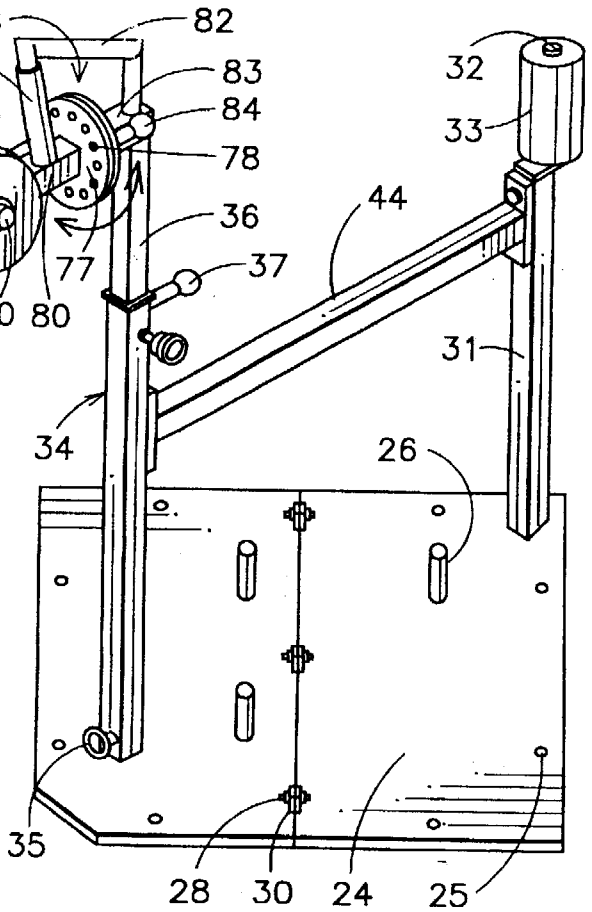
FIG. 4 is a perspective view of the board breaking attachment of FIG. 3 attached to the training apparatus of FIG. 1.
Figure 5:
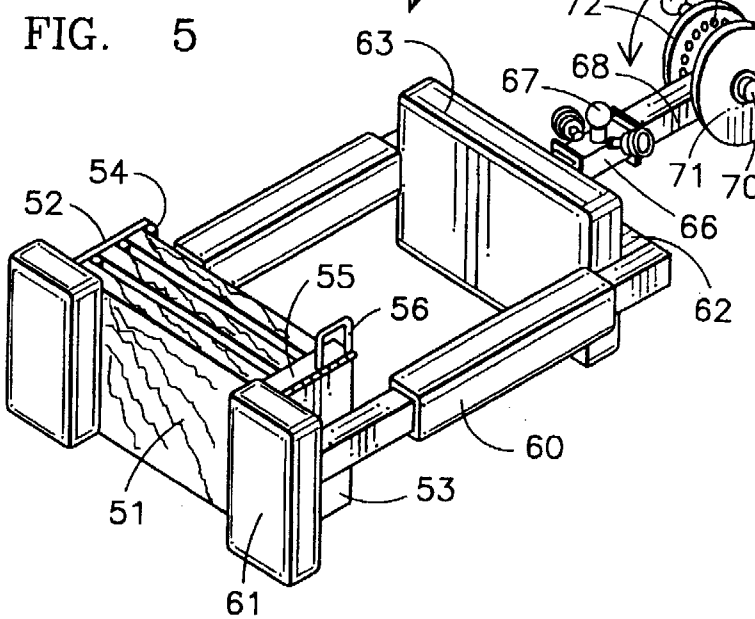
FIG. 5 is a partial perspective of the board breaking apparatus of FIGS. 3 and 4 having three boards therein.
Figure 6:
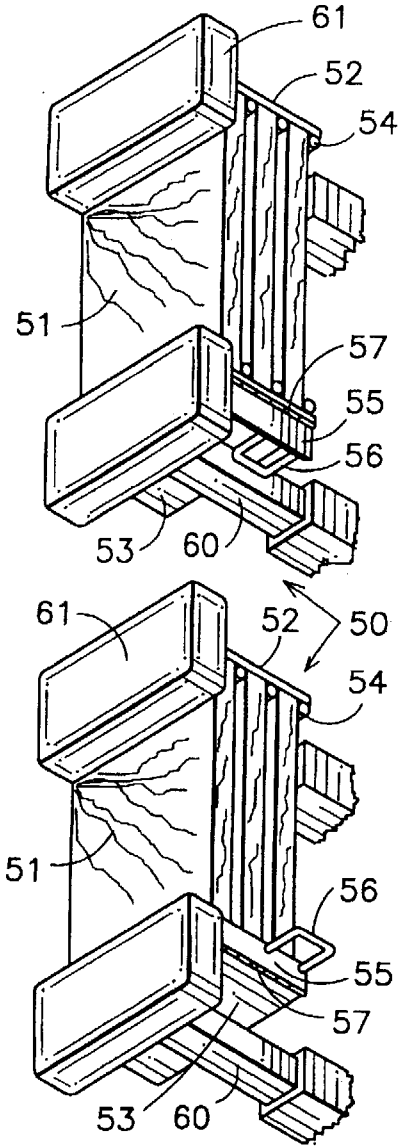
FIG. 6 is a perspective of a board breaking attaching of FIG. 5 having the boards locked therein.
Figure 7:
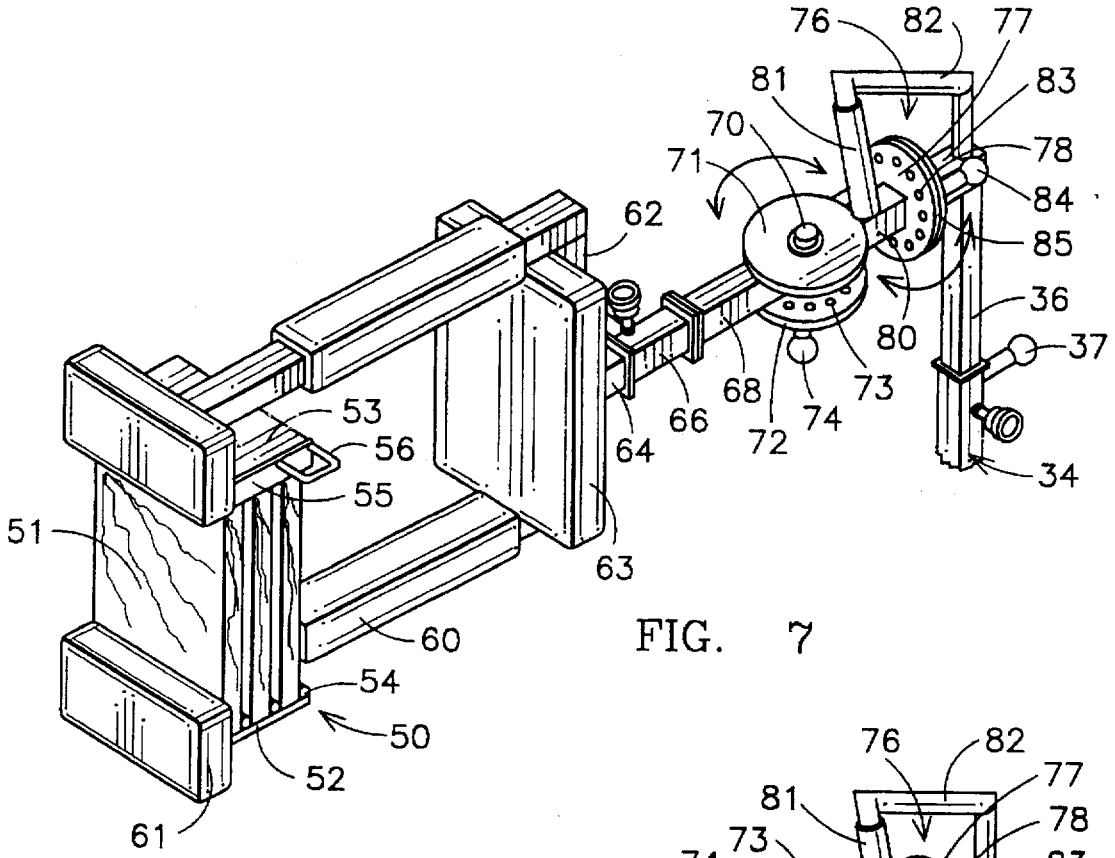
FIG. 7 is a perspective view of the board breaking attachment of FIG. 4 shown in one position.
Figure 8:
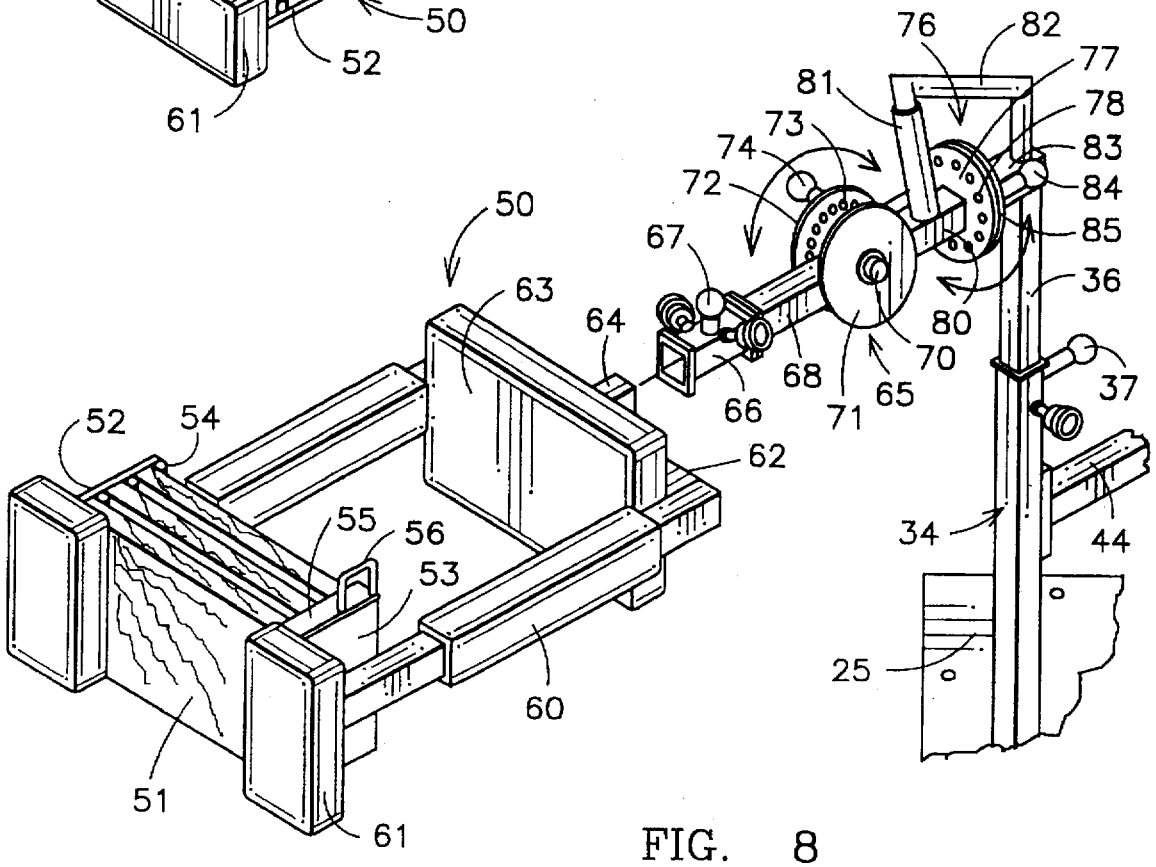
FIG. 8 is a perspective view of the board breaking attachment of FIG. 7 shown in a different position.

Turning now to FIGS. 3 through 8, the universal board breaking training attachment 50 is illustrated having three boards 51 attached therein between board support members 52 and 53. The board support members 52 and 53 each have a plurality of cylindrical ridges 54 attached in a spaced relationship to each other to form grooves therebetween for holding the boards 51. The rounded shapes of the ridges 54 allow the boards to easily break-away. The board locking frame member 53 additionally has a latching member 55 thereon with a handle 56. The latching member 55 is spring loaded and hinged to the member 53 with the hinge 57 so that the door 55 can be opened, as shown in FIG. 5, for inserting new boards and can be closed, as shown in FIG. 6, to hold the boards in place. The frame members 52 and 53 are held by the telescoping support arm 58 telescoping from a support arm 60. Each telescoping arm 58 and board support member 52 and 53 has a padded front piece 61 mounted thereto which protects the trainee 40 in the event he misses the board 51 in an attempt to break the boards. The board support also has the rear frame portion 62 supporting rear padded plate 63 which will protect the trainee in breaking the boards if the foot or hand drives through the boards and hits the pad 63.

The entire board breaking attachment has an attachment member 64 which slides into a universal attachment joint 65 having a universal attaching member 66 attached thereto with a locking pin 67. The member 64 slides within the attaching arm 66 and is locked in place with the member 67. The universal attachment joint 65 has the arm 68 supported on a hinge pin 70 having a pair of flanged sides 71 and 72. The flange side 72 has a plurality of apertures 73 therein and a lock pin 74 which locks through the aperture 73 into any desired position. Rotation is shown by the arrow. In addition, a separate rotating joint 76 has a rotating plate 77 having a plurality of apertures 78 therein for locking with a locking pin and which rotates the arm 80 connecting to the joint 65 in a rotating fashion perpendicular to the rotation of the joint 65. This gives a universal motion using the joints 65 and 76 to rotate to a desired position. In addition, the support arm 80 has a protruding arm 81 which can be locked in a predetermined place for additional support with the generally U-shaped arm 82 attached to the frame member 83. A locking pin 84 locks the two plates 77 and 85 together in the predetermined position so that the entire board break attachment 50 can be positioned in any position, such as that shown in FIGS. 4 and 7. In FIG. 4, the board break mechanism is attached to the training attachment support 34 telescoping arm 36 extending from the base 24 and braced with the connecting frame member 44 to the wall-bracing member 31 having the wall cushioning member 33 attached thereto over the post 32. Telescoping member 36 in this case is attached to the board breaking attachment 50 and replaces the existing member 36 but telescopes in the same manner. This view also shows the vertical weight pegs 26 as well as the base assembly flanges 30 attached with the bolts 28. The base also has the apertures 25 for bolting the base to the floor. The board breaking attachment with its universal joints 65 and 76 can be readily attached to the training attachment support 34 and adjusted with the telescoping arm 36 to any desired height. Then the universal joints 65 and 76 can be rotated and locked to a desired position for breaking the board with the hand or foot from different positions as desired by the trainee 40 while protecting the trainee with a cushioned surface in the event the target boards are missed. The boards can be rapidly attached and removed with the use of a snap-closing gate 55 and the sliding in of new boards. The old boards can be easily removed by virtue of the rounded ridges 54.

Figure 9:
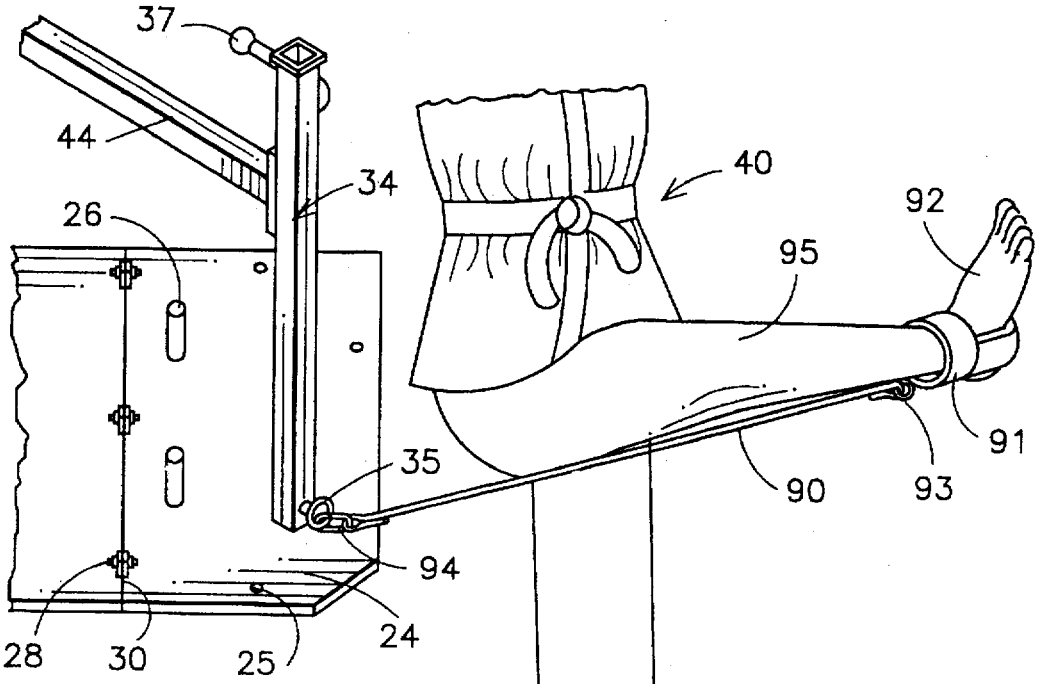
FIG. 9 is a partial perspective of a kick training attachment in use by a trainee.
Figure 10:
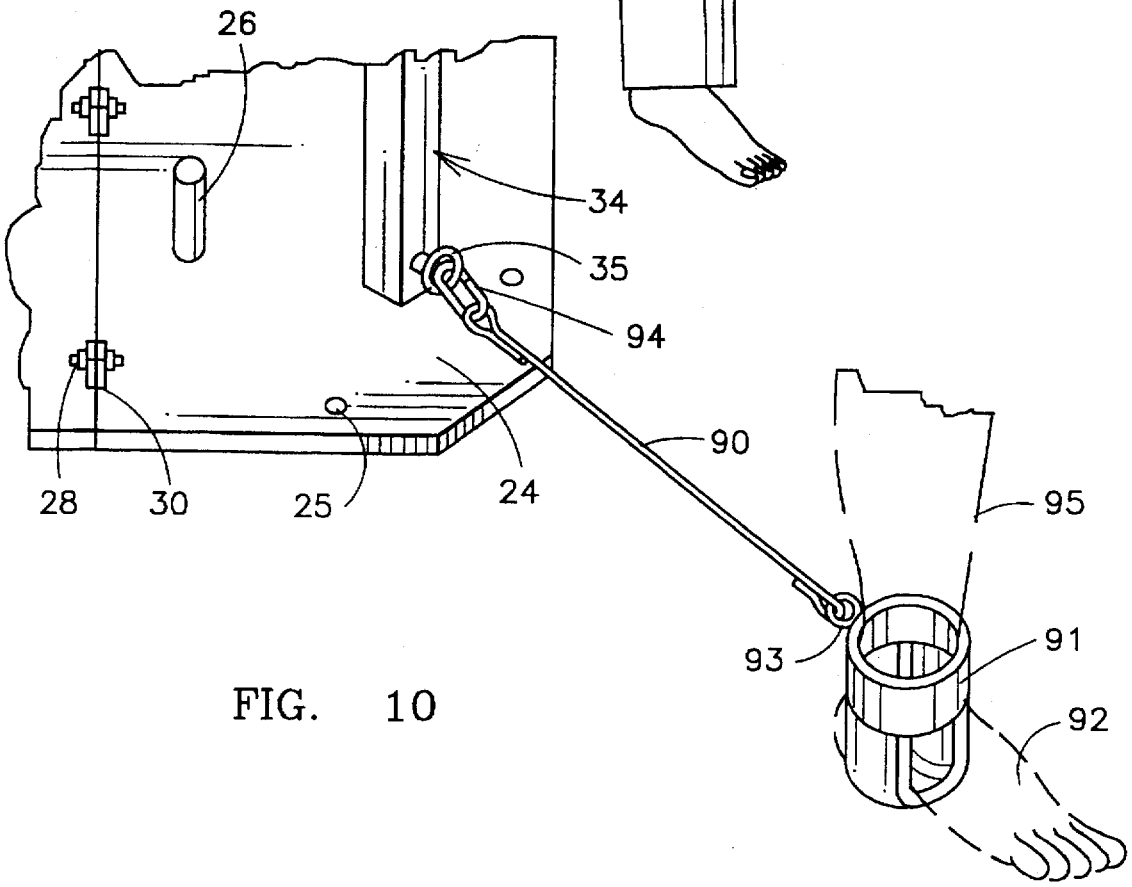
FIG. 10 is a partial perspective of the kick training attachment of FIG. 9.

Turning to FIGS. 9 and 10, the martial arts training apparatus 20 has the base 24 with the weight supporting pegs 26 and the base locking flanges 30 attached with the bolts 28 and having the training attachment support 34 supported by the connecting frame member 44. An eye 35 has a resilient cord 90 attached thereto. The trainee 40 has a foot and ankle attachment 91 attached to his foot and ankle 92. The foot and ankle attachment 91 has an eye 93 formed thereon for attaching the other end of the resilient cord 90. The resilient cord can be a bungee cord or the like. An attaching link 94 allows the resilient cord to be attached to the eye 35. Thus, the trainee 40 can be attached, as shown in FIG. 10, to swing his leg 95 against the resistance of the resilient cord 90, as shown in FIG. 9, for training and exercising the leg in various types of martial arts training.

Figure 11:
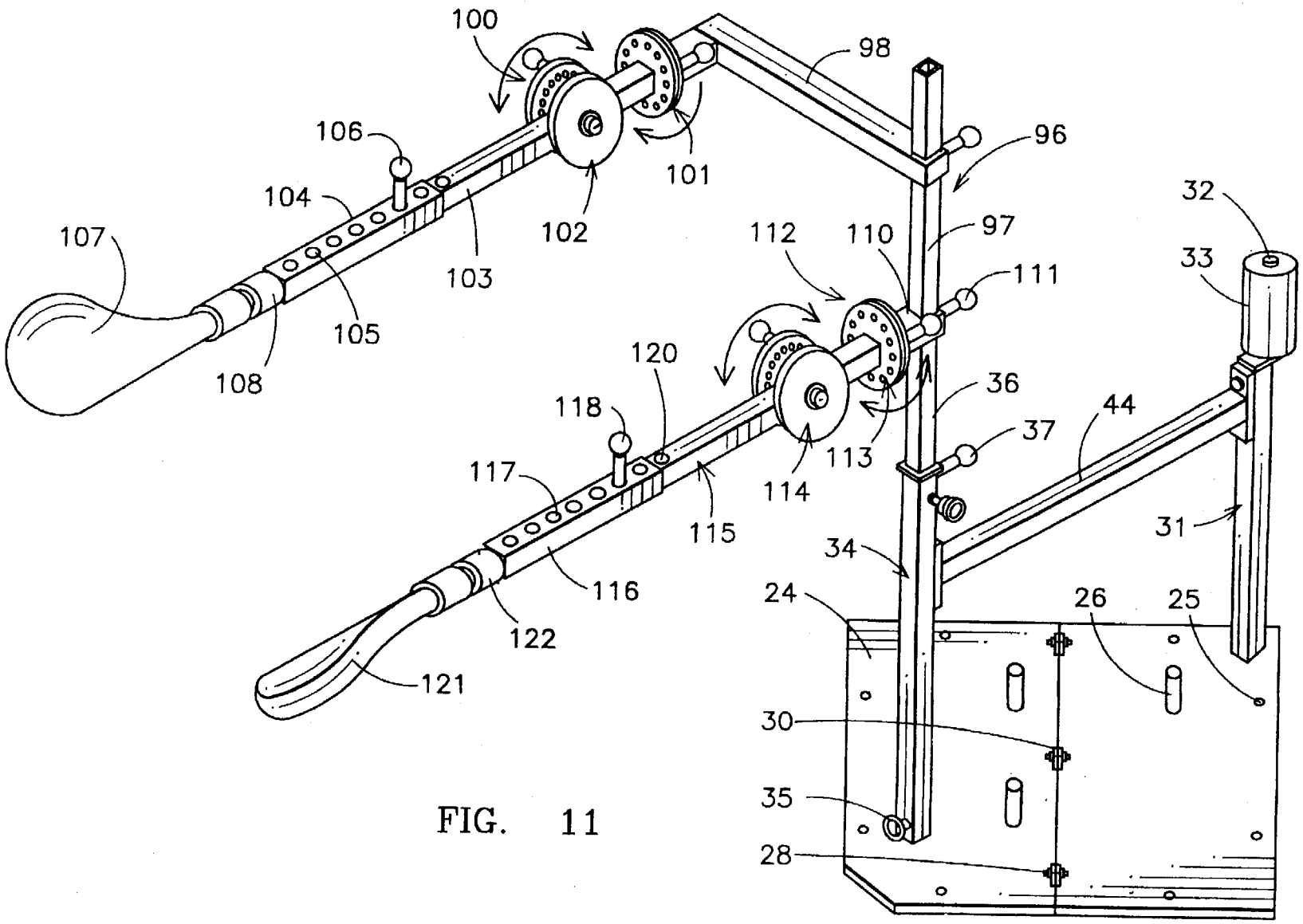
FIG. 11 is a perspective view of a double paddle attachment for the martial arts training apparatus of the present invention.

In FIG. 11, the martial arts training apparatus 20 has a base 24 with the protruding wall bracing member 31 and wall supporting cushion 33 held on the post 32 and braced by the connecting frame member 44 to the training attachment support 34. The base has the weight supporting pegs 26 along with the flange locking members 30 and the bolts 28 attaching the base members together. The telescoping training attachment support member 36 has a double paddle training attachment 96 attached thereto which includes an extension post 97 having a top paddle arm 98 extending therefrom and having a universal joint 100 having the rotating locking portion 101 and the rotating locking portion 102 the same as illustrated in connection with the board breaking universal attachment in FIGS. 7 and 8. The extending arm 103 has a telescoping portion 104 having a plurality of apertures 105 therein and a locking pin 106 for adjusting the position of a paddle 107. The paddle is locked with the locking portions 108 to the arm portion 104. A second paddle arm 110 is attached to the arm 97 with an attaching pin 111 and is universally supported on a universal joint 112 having a rotating joint 113 and a rotating joint 114 rotating generally perpendicular to each other so that the arm 115 can be positioned in any position desired. The arm 115 has a telescoping arm 116 having a plurality of apertures 117 therein and a locking pin 118 which locks the arm 116 to the arm 115 through the aperture 120 in the arm 115. A paddle 121 is rotatably locked with the collars 122 to the member 116.

Figure 12:
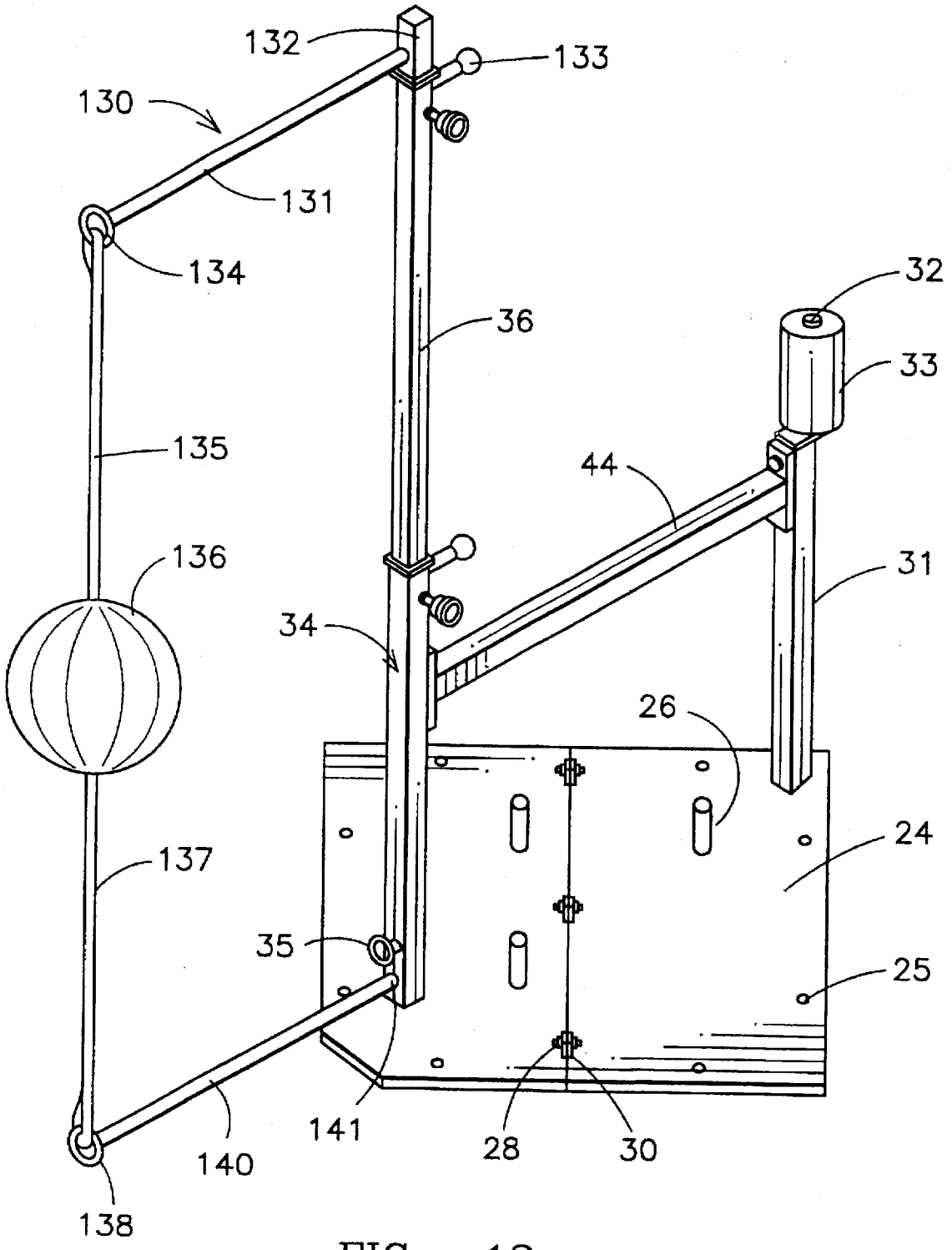
FIG. 12 is a double string bag attachment for the martial arts training apparatus of the present invention.

In FIG. 12, a martial arts training apparatus 20 has the base 24 with the weight supporting pins 26 and the locking bolts 28 locking through the bolt flanges 30 and having the apertures 25 therein along with the wall bracing member 31 having the cushioning wall member 33 supported on the post 32. The connecting brace 44 connects to the training attachment support 34 having a telescoping arm 36. A double string bag attachment 130 has an upper support arm 131 attached to an attachment portion 132 which attaches to the telescoping arm 136 and can be locked thereon with the pin 133. The arm 131 has a eye ring 134 on the end thereof and has a resilient cord 135, such as a bungee cord, attached thereto. The resilient cord 135 is attached to a bag 136 which can be an inflatable or solid filled bag and has a resilient cord 137 attached to the bottom thereof. The resilient cord 137 is attached to an eye ring 138 on the lower support arm 140. The lower support arm 140 is attached to the training attachment support 34 through an opening 141.

The double string bag attachment 130 can be rapidly attached to the universal martial arts training apparatus and quickly removed and replaced with the universal adjustable board breaking attachment of FIGS. 3–8 or with the padded striking pad of FIGS. 1 and 2 or with a single or double paddle attachment of FIG.11 or with a kicking training aid, as shown in FIGS. 9 and 10. Other attachments can be readily fitted to the training apparatus without departing from the spirit and scope of the invention. The martial arts training apparatus 20 can be rapidly disassembled and assembled by the separation of the base 24 into two components and by the removal of the training attachment support 34 and the bracing frame member 31 from the base and the disassembly of the connecting frame member 44. When assembled and placed in the corner between intersecting walls, it is firmly braced against the bottom edge of the walls and between the walls with the padded wall cushioning member 33 and takes up a relatively small amount of space within a room. Attachments can be rapidly added and removed as desired for whatever training is desired by a trainee. However, it should be clear that the present invention is not to be limited to the forms shown which are to be considered illustrative rather than restrictive.

I claim:

1. A martial arts training apparatus comprising:

a base;

bracing frame member attached to said base and extending generally vertically therefrom adjacent a building wall;

a wall bracing member attached to said bracing frame member and positioned to abut an adjacent wall;

a training attachment support for supporting a training attachment thereto, said training attachment support being attached to said base and extending generally vertically therefrom;

a connecting frame member connecting said bracing frame member and said training attachment support; and a martial arts training attachment removably attached to said training attachment support whereby a martial arts training apparatus can be placed adjacent a building wall for martial arts training.

2. A martial arts training apparatus in accordance with claim 1 in which said base has a plurality of vertically extending weight rods for removably holding weight members thereto.

3. A martial arts training apparatus in accordance with claim 2 in which said base has a plurality of base members removably attached together.

4. A martial arts training apparatus in accordance with claim 3 in which base is shaped to fit against two intersecting walls and said wall bracing member is positioned to brace against said two intersecting walls.

5. A martial arts training apparatus in accordance with claim 4 in which said martial arts training attachment includes a cushioned strike pad removably attached to said training attachment support.

6. A martial arts training apparatus in accordance with claim 4 in which said martial arts training attachment includes a board support frame for practicing board breaking removably attached to said training attachment support.

7. A martial arts training apparatus in accordance with claim 4 in which said martial arts training attachment includes a board support frame for supporting a plurality of boards for practicing board breaking of a plurality of boards.

8. A martial arts training apparatus in accordance with claim 7 in which said martial arts training attachment board support frame for practicing board breaking has a pair of rotatably adjustable attachments for adjusting the position of said board supporting frame.

9. A martial arts training apparatus in accordance with claim 8 in which said training attachment support has a least one eye attached thereto for attaching a flexible resilient cord thereto.

10. A martial arts training apparatus in accordance with claim 1 in which said training attachment support has a flexible resilient cord attached thereto having a ankle attachment on one end thereof.

11. A martial arts training apparatus in accordance with claim 1 in which said training attachment support has at least two eyes attached thereto for attaching a pair of flexible resilient cords thereto having a bag attached therebetween.

12. A martial arts training apparatus in accordance with claim 1 in which said training attachment support has a telescoping member having an adjusting pin connector for adjusting the height of said training attachment support.

13. A martial arts training apparatus in accordance with claim 1 in which said training attachment support has a kick paddle attachment removably attachable thereto for attaching a plurality of kick paddles.

14. A martial arts training apparatus in accordance with claim 1 wherein said cushion member is generally cylindrical.

15. A martial arts training apparatus in accordance with claim 1 in which said martial arts training attachment includes a board support frame for practicing board breaking removably attached to said training attachment support, said board support frame having a plurality of grooves formed with a plurality of rounded edge ridges in each of two board support members for removably supporting a board therein.

16. A martial arts training apparatus in accordance with claim 15 in which said martial arts training attachment board support frame has a snap spring loaded door for holding said boards in said board support frame.

17. A martial arts training apparatus comprising:

a base positionable to abut a pair of intersecting walls and having a plurality of weight attaching members thereon for holding a plurality of weights to said base;

bracing frame member removably attached to said base adjacent a building wall;

a wall bracing member attached to said bracing frame member and positioned to abut a pair of adjacent intersecting walls;

training attachment frame member for supporting a training attachment thereto, said training attachment frame member being removably attached to said base and extending therefrom;

a connecting frame member removably connected between said bracing frame member and said training attachment frame member above said base; and a martial arts training attachment removably attached to said training attachment support whereby a martial arts training apparatus can be easily assembled and disassembled for placement adjacent building intersecting walls for martial arts training.

18. A martial arts training apparatus in accordance with claim 17 in which said martial arts training attachment includes a board support frame for practicing board breaking removably attached to said training attachment frame member.

19. A martial arts training apparatus in accordance with claim 18 in which said martial arts training attachment board support frame for practicing board breaking has a pair of rotatably adjustable attachments for adjusting the position of said board supporting frame and each rotatably adjustable attachment has a pair of abutting flanges, each having a plurality of openings therein and a locking pin to lock one said rotatable flange to the other flange in a plurality of positions.

20. A martial arts training apparatus in accordance with claim 18 in which said martial arts training attachment board support frame for practicing board breaking has a pair of telescoping arms for adjusting the position of a pair of board supporting members.

* * * * *